US006223930B1

(12) United States Patent
Watson

(10) Patent No.: US 6,223,930 B1
(45) Date of Patent: May 1, 2001

(54) PLASTIC DRUM WITH DRAIN SUMP

(75) Inventor: Lowell George Watson, Belleville (CA)

(73) Assignee: Greif Bros. Corporation of Ohio, Inc., Delaware, OH (US)

( * ) Notice: Subject to any disclaimer, the term of this patent is extended or adjusted under 35 U.S.C. 154(b) by 0 days.

(21) Appl. No.: 09/438,471

(22) Filed: Nov. 12, 1999

Related U.S. Application Data

(62) Division of application No. 09/170,209, filed on Oct. 13, 1998, now Pat. No. 6,047,846, which is a continuation of application No. 08/107,905, filed on Aug. 17, 1993, now abandoned, which is a continuation of application No. 08/015,081, filed on Feb. 8, 1993, now abandoned, which is a continuation of application No. 07/860,202, filed on Mar. 26, 1992, now abandoned, which is a continuation of application No. 07/660,699, filed on Feb. 25, 1991, now abandoned.

(51) Int. Cl.[7] ..... B65D 21/00
(52) U.S. Cl. ..... 220/601; 220/4.04; 220/4.05
(58) Field of Search ..... 220/4.05, 4.04, 220/4.06, 601, 623, 372

(56) References Cited

U.S. PATENT DOCUMENTS

| | | | | |
|---|---|---|---|---|
| 128,051 | | 6/1872 | Manning . | |
| 1,619,492 | * | 3/1927 | Spaeth | 222/379 |
| 2,087,349 | * | 7/1937 | Lueker | 220/4.04 |
| 2,656,314 | | 10/1953 | Osterheld . | |
| 2,657,826 | | 11/1953 | Ludowitz . | |
| 3,129,730 | | 4/1964 | Simon . | |
| 3,170,586 | * | 2/1965 | Bulgrin | 220/4.04 |
| 3,370,737 | | 2/1968 | Ainslie . | |
| 3,952,904 | * | 4/1976 | Verlinden | 220/4.05 |
| 4,022,345 | * | 5/1977 | Butz | 220/85 K X |
| 4,088,239 | * | 5/1978 | Uhlig | 220/4.05 X |
| 4,557,406 | | 12/1985 | Olinger . | |
| 4,690,299 | | 9/1987 | Cannon . | |
| 4,779,754 | | 10/1988 | Ten Eyck . | |
| 4,785,958 | | 11/1988 | Snyder . | |
| 4,793,491 | | 12/1988 | Wolf . | |
| 4,828,131 | * | 5/1989 | Strubel | 220/4.04 X |
| 4,840,284 | | 6/1989 | Snyder . | |
| 4,927,040 | * | 5/1990 | Cramer | 220/601 |
| 5,184,751 | * | 2/1993 | Middleton | 220/601 |
| 5,199,570 | * | 4/1993 | McKenzie | 220/4.05 X |
| 6,047,846 | * | 4/2000 | Watson | 220/4.05 X |

FOREIGN PATENT DOCUMENTS

| | | | | |
|---|---|---|---|---|
| 658594 | * | 7/1965 | (BE) | 220/4.05 |
| 379230 | | 1/1939 | (CA) . | |

* cited by examiner

*Primary Examiner*—Steven Pollard
(74) *Attorney, Agent, or Firm*—Vorys, Sater, Seymour and Pease LLP

(57) ABSTRACT

A plastic drum is formed with a body having at access hole on top and protective chimes. The body also includes a sloping bottom with a sump aligned with the access hole to allow, substantially, all the contents of the drum to be removed without turning the body upside down.

14 Claims, 2 Drawing Sheets

PLASTIC DRUM WITH DRAIN SUMP

CROSS-REFERENCE TO RELATED APPLICATION

This application is a division of application Ser. No. 09/170,209 filed Oct. 13, 1998, now U.S. Pat. No. 6,047,896, which is a continuation of application Ser. No. 08/107,905 filed Aug. 17, 1993 (abandoned), which is a continuation of application Ser. No. 08/015,081 filed Feb. 8, 1993 (abandoned), which is a continuation of application Ser. No. 07/860,202 filed Mar. 26, 1992 (abandoned), which is a continuation of application Ser. No. 07/660,699 filed Feb. 25, 1991 (abandoned).

BACKGROUND OF THE INVENTION

A. Field of Invention

This invention relates to a unitary plastic drum for shipping and storing various materials, and more specifically to a plastic drum for liquid materials, which drum has a sloping bottom with a sump so that all the liquid can be pumped out efficiently.

B. Description of the Prior Art

Plastic drums are used frequently to ship and store various materials. These types of drums are preferred over metal drums because they are simpler and cheaper to make, easier to handle, and weigh less. Frequently, plastic drums are used to ship liquid materials used in agriculture, or the chemical industry which are highly concentrated and therefore, must be diluted. Since these liquids are very expensive, it is important that all the contents of the drum be removed before the drum is discarded or returned, to eliminate waste. One method of emptying completely the contents of a plastic drum would be to turn the drum upside down. However, this procedure is time-consuming and requires special equipment. Moreover, if the drum contains hazardous materials, turning the drum over may result in a spill, which is both uneconomical and undesirable.

Hence, there is a great need in the art for a plastic drum which could be emptied efficiently.

OBJECTIVES AND SUMMARY OF THE INVENTION

In view of the above-mentioned disadvantages of the prior art, it is an objective of the present invention to provide a plastic drum which can be efficiently emptied without turning it over.

Yet a further objective is to provide a plastic drum which can be made efficiently and economically for example by blow molding.

Another objective of the invention is to provide a drum which can be emptied efficiently using standard equipment.

Other objectives and advantages of the invention shall become apparent form the following description of the invention. Briefly, a plastic drum constructed in accordance with this invention consists of a substantially cylindrical plastic body having a straight side, a top and a sloping bottom. At least one access hole is provided on the top for filling and emptying the drum, said hole being off-center. The bottom is formed with a sump which is vertically aligned with the access hole whereby as the drum is emptied, all the liquid collects in the sump and is easily removed. A top and a bottom chime are added to the body for protection as well as to insure that the drum stands upright or vertical when resting on a horizontal surface, and to ease handling.

DETAILED DESCRIPTION OF THE INVENTION

Figure 1:
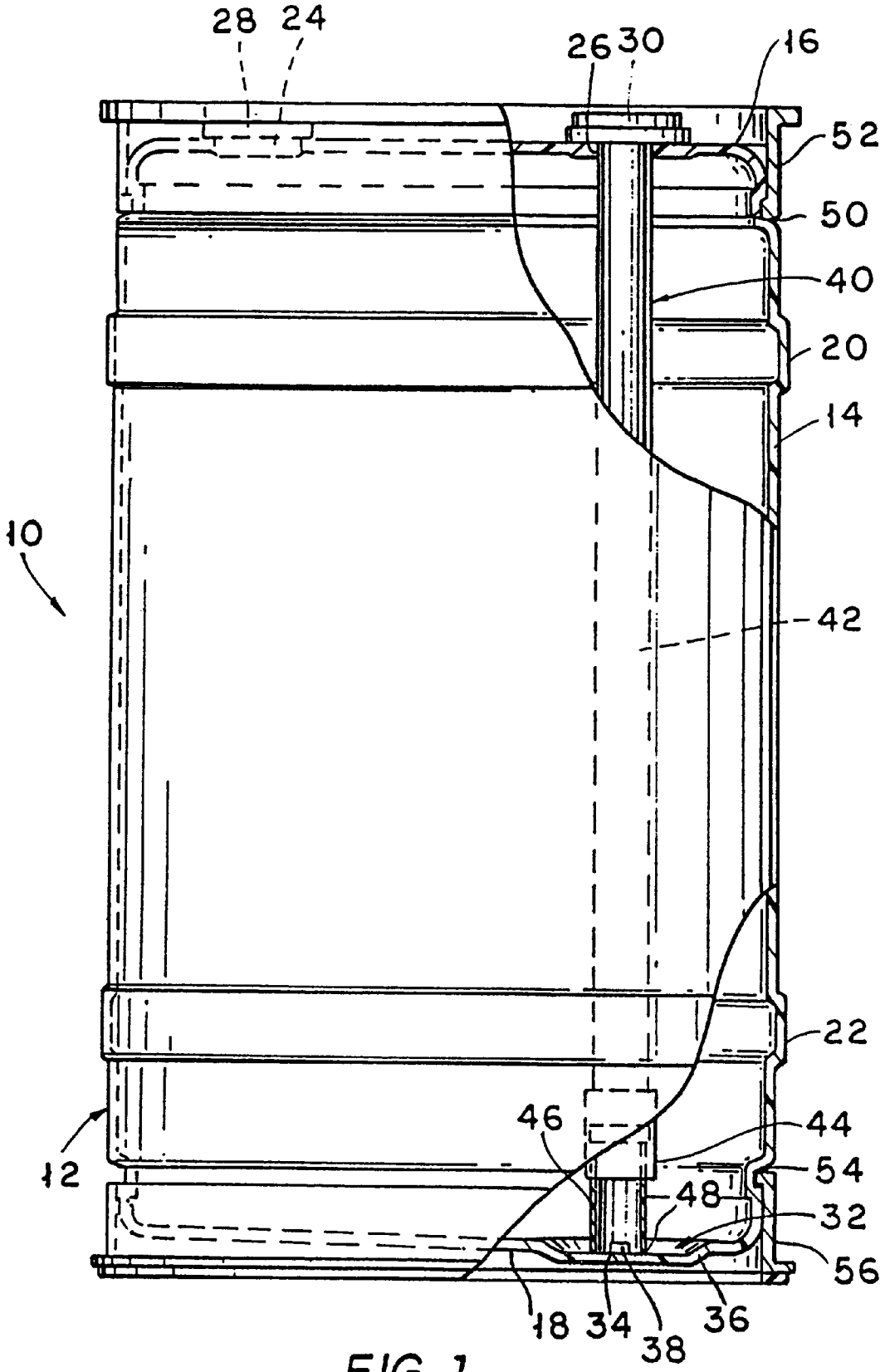
FIG. 1 shows a partial elevational view of a drum constructed in accordance with this invention.
Figure 2:
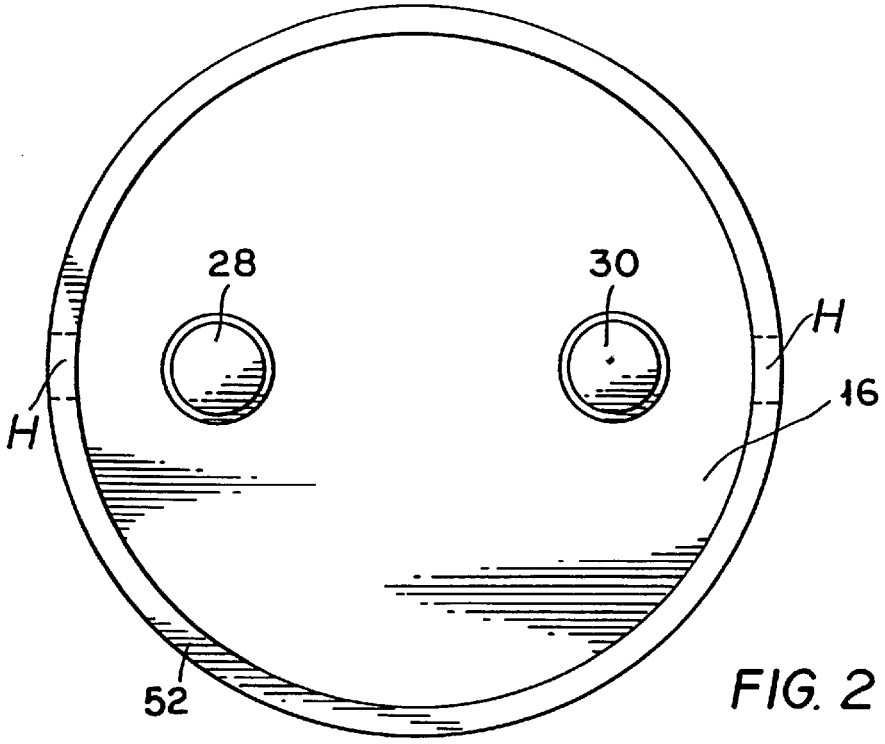
FIG. 2 shows a top view of the drum.
Figure 3:
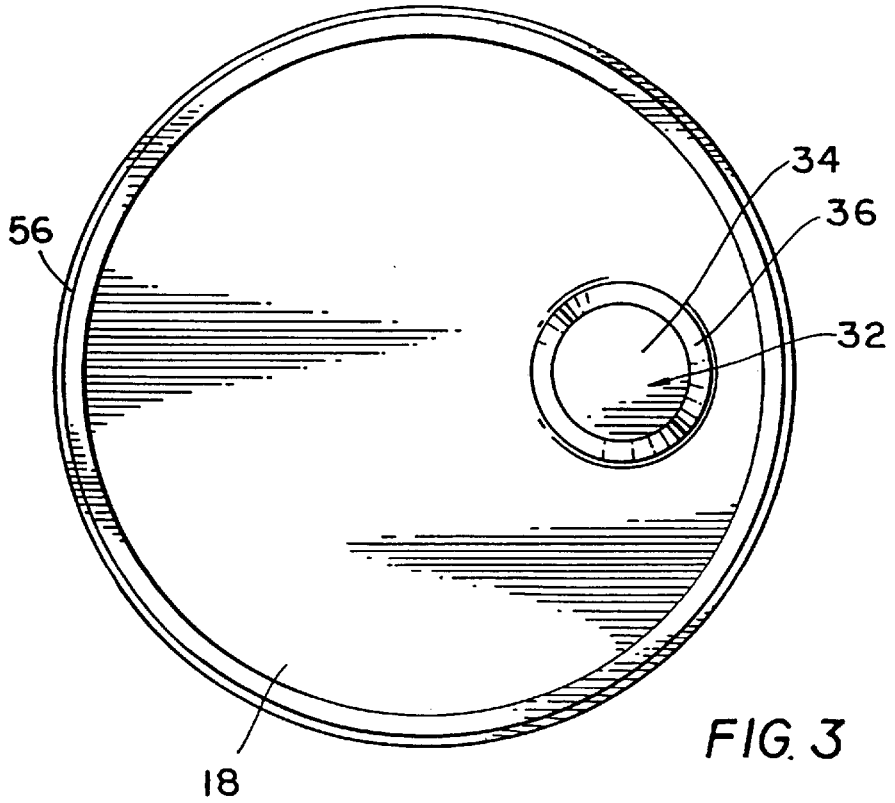
FIG. 3 shows a bottom view thereof.

Referring now to the drawings, a drum 10 constructed in accordance with this invention includes a body 12 having a cylindrical sidewall 14, a top 16 and a sloping bottom 18. Body 12 is made of a plastic material and is formed by blow molding. Sidewall 14 is formed with a pair of circumferential ribs 20, 22 which reinforce the body 12 and also facilitate handling the drum. Top 16 is formed with two circular access holes 24, 26 covered by suitable closures 28, 30. Holes 24, 26 are advantageously disposed away from the longitudinal axis of the drum so that it is easy to install and remove the closures, and it is easy to fill up and empty the drum.

A sloping bottom 18 is formed with a sump 32 defined by a flat area 34 joined to the rest of the bottom by a conical wall 36. Flat area 34 is circular and has a diameter which is slightly larger than access hole 26. Importantly, area 34 is aligned vertically and coaxially with hole 26 and, as shown in FIG. 1, defines the lowest area of bottom 18. Disposed on surface 34 is a boss 38. Extending between hole 26 and sump 32 is a draining pipe 40. At its top portion, draining pipe 40 is supported by access hole 26. Draining pipe 40 can be permanently installed within the drum, or it may be provided separately, and installed only prior to the dispensing of liquid therefrom. As shown in detail in FIG. 1, draining pipe 40 includes an upper section 42, a sleeve 44 and a lower stub 46. Upper section 42 and stub 46 are axially movable within the sleeve 44 to adjust the overall length of pipe 40. In this manner the pipe 40 can be adjusted so its length matches exactly the inner height of body 12. The stub 46 is terminated with a bottom end 48 which is provided with perforations or holes (not shown) to provide a passageway for liquid from the sump to enter into the drain pipe 40. In this manner, the liquid from drum 10 may be dispensed for example by applying suction to pipe 40, or by other means well known in the art. Boss 34 is used to align the bottom of pipe 40 with respect to sump.32.

At, or near, the interface between sidewall 14 and top 16, there is provided a circumferential groove 50. This groove is used to hold a circumferential chime 52 disposed around the body 12. A similar groove 54 is used at the bottom of body 12 to hold a second chime 56. Chimes 52, 56 are used to reinforce and protect the body 12. More particularly, these chimes 52, 56 extend axially beyond closure 30 on top, or sump 32 on the bottom respectively, forming a disk shaped protected space. Chimes 52, 56 may be made of plastic or a metallic material.

In addition, as mentioned above, bottom 18 is sloped. Chime 56 preferably has a uniform height and is mounted in such a manner as to insure that drum 10 stands upright. Without chime 56, drum 10 would tilt to one side and could not be stacked. Top chime 52 maybe provided with several small holes (not shown) to allow excess liquid to drain off from the side of the drum. In addition, chime 52 maybe provided with several larger holes such as H. A chain or a rope maybe passed through these holes for lifting the drum 10. Chime 52 is also rimmed as at R to permit handling of the drum with a mechanical means such as by parrot beaks, lift truck forkes or drum buggies.

The drum is made by first, blow-molding the body 12 to form a unitary structure, and then applying the chimes 52, 56 thereto. As mentioned before, pipe 40 may be inserted into the drum body either before shipping, or before dispensing of the liquid.

The drum described in the figure is filled through one of the access holes, such as access 24. Although the other access hole 26 may also be used, access hole 24 is preferable because it permits the liquid to flow in much faster, while if hole 26 is used, the liquid flow will be impeded somewhat by pipe 40. Once the drum is filled the closures are applied to seal the drum 10. The drum is stored or shipped as required. The liquid is dispensed, for example, by coupling drain pipe 40 to a suitable pump. Importantly, bottom is sloping toward sump 32 so that surface 34 of sump 32 is the lowest surface within the drum, and since the area of the sump 32 is relative small when compared to the total area of bottom 18, at the end, substantially all the liquid in the drum is collected in sump 32 and may be easily removed therefrom.

Obviously numerous modifications may be made to this invention without departing from its scope as defined in the appended claims.

What is claimed is:

1. A drum capable of being substantially fully drained and emptied of liquid contents, said drum comprising:

a) a unitary, blow molded plastic outer body including a side wall, a top, and a bottom, said top having an access hole radially offset from a center of said top, said bottom having a sump that is radially offset from said center and substantially vertically aligned with said access hole, said bottom being configured to guide liquid into said sump, and said sump having a relatively small area compared to a total area of said bottom, whereby substantially all of the liquid in the drum will collect in said sump; and b) a support member secured to said body in such a manner to have a portion disposed below said sump so as to assure that the drum stands upright;

said access hole being constructed for insertion of a drain pipe therethrough and into said sump, such that substantially the whole contents of said drum can be pumped out of said drum by a pump coupled to said drain pipe.

2. The drum of claim 1, wherein said access hole is disposed closer to a periphery of said top than to the center of said top.

3. The drum of claim 1, wherein said support member is a lower chime disposed around said bottom and secured to said body.

4. The drum of claim 1, wherein said bottom further comprises a boss disposed on a base of said sump to be received in a bottom of said drain pipe to maintain substantially vertical alignment of said drain pipe.

5. The drum of claim 4, wherein a base of said sump includes a flat surface and the sump includes a conical section joined to said base.

6. The drum of claim 5, wherein said flat surface and access hole are circular and a diameter of said flat surface is slightly larger than a diameter of said access hole.

7. In combination, a drum constructed to permit substantially complete emptying of liquid contents, and a drain pip for emptying said drum, said drum comprising:

a) a unitary, blow molded plastic outer body including a side wall, a top, and a bottom, said top having an access hole radially offset from a center of said top, said bottom having a sump that is radially offset from said center and substantially vertically aligned with said access hole, said bottom being configured to guide liquid into said sump, and said sump having a relatively small area compared to a total area of said bottom, whereby substantially all of the liquid in the drum will collect in said sump; and b) a support meter secured to said body in such a manner to have a portion disposed below said sump so as to assure that the drum stands upright;

said drain pipe being constructed for insertion through said access hole and having a top to be coupled to said access hole and a bottom, said drain pipe having a length such that when said top is coupled to said access hole, said bottom is received in said sump such that substantially the whole contents of said drum can be pumped out of said drum through said drain pipe.

8. The combination of claim 7, wherein said access hole is disposed closer to a periphery of said top than to the center of said top.

9. The combination of claim 7, wherein said drain pipe has an adjustable length.

10. The combination of claim 9, wherein said drain pipe comprises an upper section and a lower section adjustably coupled to each other by a sleeve.

11. The combination of claim 7, wherein said bottom further comprises a boss disposed on a base of said sump to be received in said bottom of said drain wipe to maintain substantially vertical alignment of said drain pipe.

12. The combination of claim 11, wherein a base of said sump includes a flat surface and the sump includes a conical section joined to said base.

13. The combination of claim 12, wherein said flat surface and access hole are circular and a diameter of said flat surface is slightly larger than a diameter of said access hole.

14. The combination of claim 7, wherein said bottom of said drain pipe has perforations or holes formed therein to admit liquid from said sump into said pipe.

* * * * *